US005507110A

United States Patent [19]

Chesnut et al.

[11] Patent Number: 5,507,110

[45] Date of Patent: Apr. 16, 1996

[54] CARTRIDGE MAGAZINE HAVING RESTRICTED CARTRIDGE CAPACITY

[75] Inventors: M. Gaines Chesnut, Hamilton; Dennis D. Sweet, Loma; Marc A. Ulasik, Clifton, all of Colo.

[73] Assignee: Blount, Inc., Montgomery, Ala.

[21] Appl. No.: 339,860

[22] Filed: Nov. 15, 1994

[51] Int. Cl.[6] ..... F41A 9/71

[52] U.S. Cl. ..... 42/50; 89/34

[58] Field of Search ..... 42/50, 49.02, 49.01, 42/18, 22; 89/34

[56] References Cited

U.S. PATENT DOCUMENTS

| | | | |
|---|---|---|---|
| 3,964,199 | 6/1976 | Musgrave | 42/50 |
| 4,329,802 | 5/1982 | Coonan | 42/50 |
| 4,688,344 | 8/1987 | Kim | 42/50 |
| 4,811,510 | 3/1989 | Chesnut | 42/50 |
| 4,888,899 | 12/1989 | Chesnut et al. | 42/50 |
| 5,345,660 | 9/1994 | Howard | 42/50 |

FOREIGN PATENT DOCUMENTS

| | | | |
|---|---|---|---|
| 406904 | 8/1966 | Switzerland | 42/50 |

*Primary Examiner*—Stephen M. Johnson
*Attorney, Agent, or Firm*—Sheridan Ross & McIntosh

[57] ABSTRACT

A restricted capacity cartridge magazine includes a magazine body having four walls defining a chamber for housing cartridges, a bottom end and an open end through which cartridges may exit and a follower assembly for moving cartridges through the chamber toward the open end. The follower assembly includes a follower body and a constant force spring unit. Blocking members formed in opposing side walls terminate at a slot forming opposing lips which extend a predetermined distance into the chamber to contact portions of the the lowermost cartridges in the magazine to limit the movement of cartridges away from the open end of the magazine. The constant force spring unit terminates at a length such that the magazine is disabled if the follower body is moved past a predetermined distance from the open end of the magazine.

11 Claims, 9 Drawing Sheets

CARTRIDGE MAGAZINE HAVING RESTRICTED CARTRIDGE CAPACITY

FIELD OF THE INVENTION

The present invention relates generally to magazines for storing firearm cartridges. More particularly, the present invention relates to assemblies for restricting the capacity of a cartridge magazine to a predetermined maximum number of cartridges.

BACKGROUND OF THE INVENTION

Cartridge magazines which are used for providing a plurality of cartridges to firearms are typically designed to hold a predetermined number of cartridges. The capacity of a cartridge magazine is generally a function of the length and width of the magazine, the size and orientation of the cartridges held within the magazine, and the space consumed by the follower assembly used to move cartridges through the magazine chamber. To facilitate shooting convenience, manufacturers have generally sought to maximize the cartridge capacity of their firearms, subject to design constraints. In this regard, manufacturers have designed certain handguns, such as 9 mm handguns, to receive a cartridge magazine which holds cartridges in a double-column arrangement, thereby increasing the number of cartridges which may be held by the magazine. Additionally, manufacturers have devised certain design changes, for example, those disclosed in U.S. Pat. No. 4,811,510, for extending the capacity of cartridge magazines beyond the capacity intended by the manufacturer of the firearm.

In the United States, limitations have recently been enacted on the cartridge capacity of magazines for certain firearms. This federal statute limits the cartridge capacity of many magazines to ten cartridges, which is less than the original capacity intended by manufacturers of firearms and or magazines. Additionally, it is expected that, in order to comply with federal regulations, cartridge magazine manufacturers will be required to demonstrate that their magazines cannot be readily altered by the user to increase the capacity of the magazine beyond the ten cartridge limit.

One solution to this problem is to reduce the size of the magazine, such as by reducing the length and/or width, thereby limiting the space available in the magazine to house cartridges. However, in many firearms, the size and external configuration of the cartridge magazine are dictated by the size and configuration of the firearm magazine well. Changing the size of the magazine would require corresponding changes to the firearm, which would be prohibitively expensive. Furthermore, re-tooling to provide magazines that hold less than ten cartridges would not be cost effective, given the availability of many magazines that were designed to hold more than ten cartridges. It would be advantageous, therefore, to provide an assembly for restricting the capacity of a cartridge magazine to a predetermined limit without requiring changes in the external size and configuration of the magazine.

SUMMARY OF THE INVENTION

Accordingly, one object of the present invention is to provide a cartridge magazine for use with a firearm having a capacity corresponding to a predetermined maximum limit. Another object of the present invention is to provide a cartridge magazine for use with a firearm having an assembly that disables the magazine if it is filled beyond a predetermined maximum limit. A further object of the present invention is to provide a limited capacity cartridge magazine which complies with federal statutes and regulations and which is compatible with the wells of existing firearms.

In that regard, the present invention is directed to a restricted capacity cartridge magazine for use with a firearm which includes first and second side walls and first and second end walls defining a chamber for housing cartridges, a follower assembly including a follower body for moving cartridges through the chamber, and an assembly for controlling the movement of the follower body located a predetermined distance from the open end of the magazine. The predetermined distance preferably corresponds to the amount of space required to house a predetermined number of cartridges in the magazine.

In accordance with the present invention, the capacity of a cartridge magazine may be restricted to a predetermined limit by using one or both of two aspects of the present invention. According to the first aspect of the present invention, a blocking assembly is provided for blocking movement of cartridges in the magazine in a first direction at a predetermined distance from the open end of the cartridge magazine. In one embodiment of the present invention, the blocking assembly preferably includes at least a first blocking member provided on a first wall of the follower body for engaging the lowermost cartridge in the magazine to limit its movement in a first direction away from the open end of the cartridge magazine. Even more preferably, the blocking assembly includes a second blocking member provided on a second wall of the magazine, for engaging the second lowermost cartridge in the magazine to limit its movement away from the open end of the magazine.

In a preferred embodiment of the present invention, the first and second blocking members are formed by substantially symmetrical ribs extending along a longitudinal axis in opposing side walls of the magazine. Each rib terminates at a slot located a predetermined distance from the open end of the magazine, forming a lip member which extends a distance into the magazine chamber to engage a portion of a cartridge, thereby limiting movement of the cartridge away from the open end of the magazine.

According to a second aspect of the present invention, an assembly is provided for disabling the magazine when the follower body is moved farther than a predetermined distance from the open end of the magazine. Preferably, this aspect of the invention involves the use of a follower assembly having a force storing member, such as a spring, which, when the follower body is moved farther than a predetermined distance from the open end of the magazine, exerts insufficient force on the follower body to move the follower body toward the open end of the magazine.

In one embodiment of the invention, the follower assembly preferably includes at least a first conforce spring interconnected with the follower body and having a length which, when the follower body is moved farther than a predetermined distance from the open end of the magazine, causes the conforce spring to exert insufficient force on the follower body to move the follower body toward the open end of the magazine. Even more preferably, the conforce spring has a length which allows the spring to disconnect from the follower body when the follower body is moved more than a predetermined distance from the open end, thereby disabling the magazine.

Further advantages of the present invention will become clear from the following discussion, when taken in conjunction with the accompanying drawings

DETAILED DESCRIPTION

The present invention provides a cartridge magazine having a cartridge capacity which is restricted to a predetermined limit. Additionally, the present invention provides an assembly for use in disabling the magazine when the follower body is moved more than a predetermined distance from the open end of the magazine. While the present invention will be described particularly with reference to a cartridge magazine for use with a 9 mm firearm, principles of the present invention are applicable to magazines for use with a broad spectrum of firearms and it is intended that the invention not be limited to cartridge magazines for use with a particular firearm.

Figure 1:
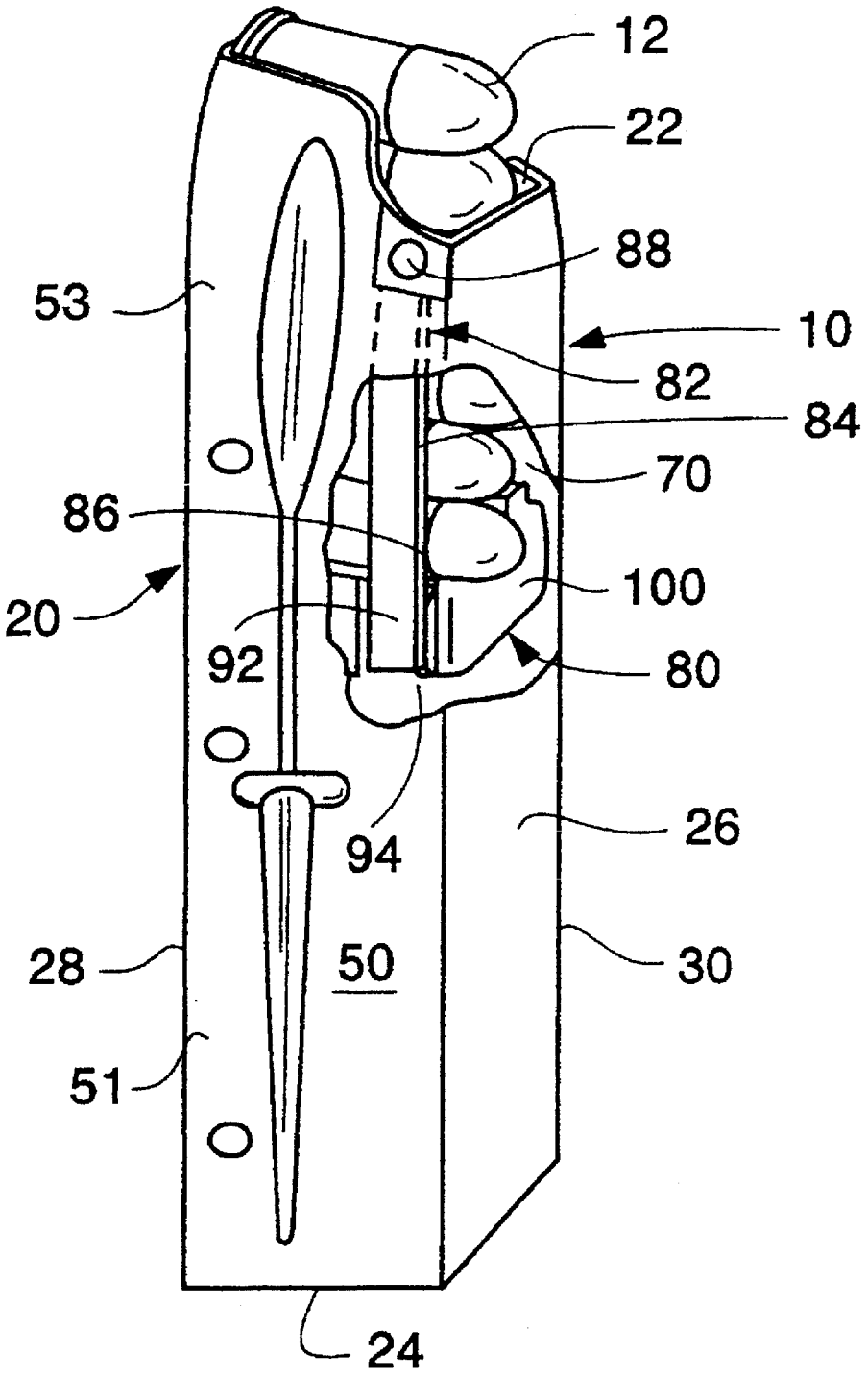
FIG. 1 is a perspective view of one embodiment of a cartridge magazine in accordance with the present invention.

FIG. 1 illustrates, in perspective view, one embodiment of a 9 mm cartridge magazine in accordance with the present invention. The magazine 10 includes a body 20 and a follower assembly 80. The magazine body 20 is used in housing nine millimeter cartridges 12 in a staggered double-column relationship. The follower assembly 80 is used in moving the cartridges 12 in and out of the magazine body 20.

The body 20 of the magazine has an open end 22 and a bottom end 24. During loading, as each successive cartridge 12 is inserted into the magazine body 20 the stack of cartridges 12 moves downwardly from the open end 22 toward the bottom end 24. During use, as each successive cartridge 12 is ejected from the magazine 10 into the firing chamber of the firearm it passes through the open end 22 of the magazine 10 and the remaining cartridges 12 move upwardly toward the open end 22 of magazine 10.

Figure 4:
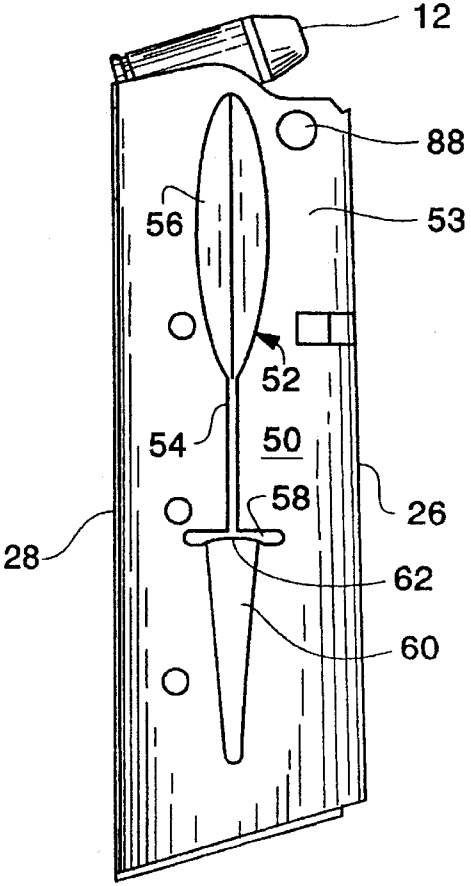
FIG. 4 is a second side view of the cartridge magazine illustrated in FIG. 3.
Figure 2:
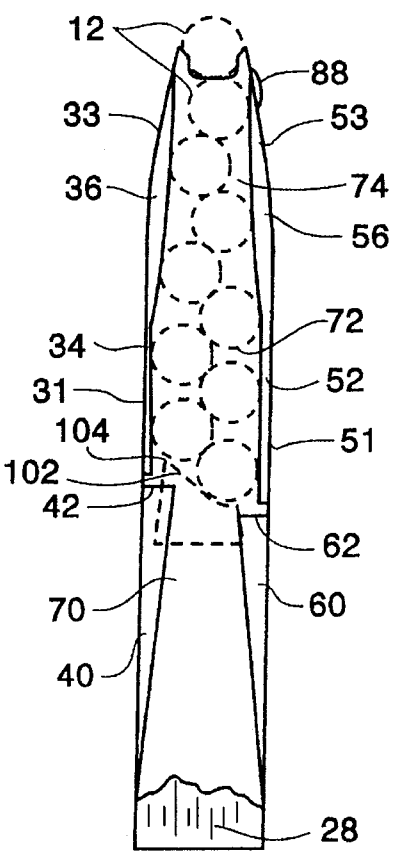
FIG. 2 is a rear view of the cartridge magazine shown in FIG. 1, with a portion of the rear wall removed, illustrating placement of the cartridges and the follower body, shown in phantom, when the magazine is filled to its predetermined maximum capacity.
Figure 3:
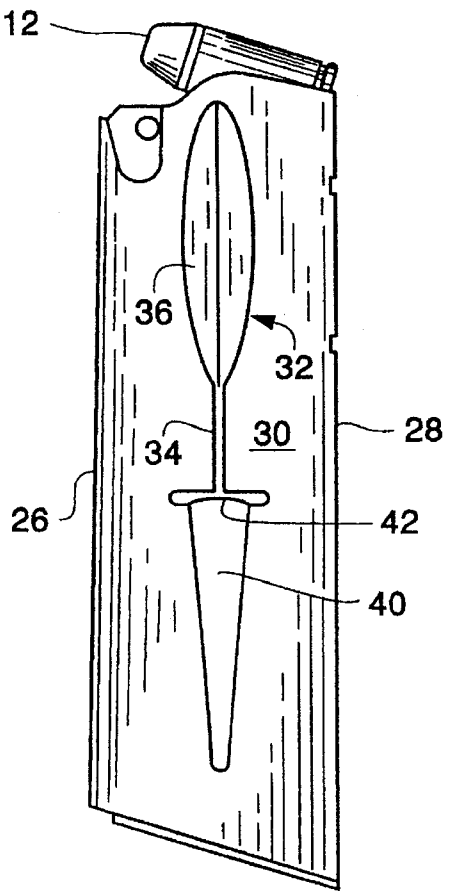
FIG. 3 is a first side view of a cartridge magazine in accordance with one embodiment of the present invention.

Referring also to FIGS. 2–4, magazine body 20 includes a front wall 26, a rear wall 28, and first and second side walls, 30, 50 defining a chamber 70 for housing cartridges 12. Magazine body 20 is substantially symmetrical about a longitudinal axis through the center of front wall 26. Front wall 26 and rear wall 28 are substantially planar, while side walls 30, 50 each have a major portion 31, 51, respectively, which is substantially planar and a minor portion 33, 53, respectively, which curves inwardly toward a longitudinal axis through the center of front wall 26. Chamber 70 can be characterized as including a major section 72 in which cartridges are held in a staggered double-column arrangement, wherein the cartridges are angularly offset from one another, and a transition section 74 in which the cartridges 12 form a single column to facilitate passing through the open end 22 of magazine 10.

Referring to FIG. 4, side wall 50 includes an upper rib 52 extending along a longitudinal axis substantially through the center of side wall 50. Upper rib 52 extends a predetermined depth into chamber 70 to contact desired portions of cartridges 12 to maintain a gap between the exposed surface of conforce spring unit 82 and the cartridges 12 in chamber 70. Maintaining a gap between the cartridges 12 and the conforce spring 82 facilitates the smooth flow of cartridges 12 through the chamber 70. Upper rib 52 has a narrow portion 54 which extends along a length of the major portion 51 of side wall 50 and a fanned portion 56 which extends primarily along a length of the minor portion 53 of side wall 50. In addition to maintaining a gap between cartridges 12 and conforce spring unit 82, fanned portion 56 forms a segment of the transition zone 74 in which the cartridges form a single column.

Side wall 50 also includes a lower rib 60 which extends along a longitudinal axis through the center of side wall 50. Lower rib 60 increases in width and depth from the bottom of side wall 50 to its termination point at slot 58. The upper surface of lower rib 60 forms a lip 62 which extends a predetermined distance into chamber 70 to engage a portion of the lowermost cartridge in the magazine to prevent movement of the lowermost cartridge beyond lip 62. In a preferred embodiment, lip 62 extends at least about 0.080 inch into chamber 70 to engage a portion of the lowermost cartridge in the magazine to prevent movement of lowermost cartridge beyond lip 62.

Referring to FIGS. 2 and 3, it can be seen that side wall 30 is substantially similar to side wall 50 and includes an upper rib 32 and a lower rib 40 disposed on a longitudinal axis through the center of side wall 30 which are substantially identical to the ribs on side wall 50. The narrow portion 34 of upper rib 32 acts to reduce possible jamming problems by providing symmetry for the first and second columns of cartridges 12 housed in the major section 72 of the magazine. The fanned portion 36 of upper rib 32 forms a segment of the transition zone 74 in which the cartridges form a single column. The lip 42 of lower rib 40 also extends a predetermined distance into chamber 70 to engage the second lowermost cartridge in the magazine to prevent movement beyond lip 42.

Referring again to FIG. 1, the follower assembly 80 includes a follower body 100 and a spring unit 82 for use in providing a uniform or constant force to the follower body 100 to move cartridges 12 through the chamber 70 of the magazine body 20 toward the open end 22 of magazine 10.

In a preferred embodiment, the constant force spring unit 82 comprises a pair of conforce springs, 84, 86 wound together. The conforce springs 84, 86 are separated but are aligned so that, when unwound, their longitudinal extents are substantially contiguously adjacent. It has been determined that using two conforce springs of narrower gauge material is preferable to using a single conforce spring of a heavier gauge. However it will be appreciated that the present invention may be practiced using any number of springs sufficient to provide the required force to move follower body 100 toward the open end 22 of the magazine 10. A free end of conforce springs 84, 86 are connected to the side wall 50 of the magazine 10 using a rivet 90 or other conventional fasteners.

The spring unit 82 may be characterized as having an unwound portion 92 and a wound portion 94. The wound portion 94 of spring unit 82 contacts follower body 100 to exert a force on follower body 100. As can be appreciated, as the cartridges 12 are loaded into the magazine 10, the length of the unwound portion 92 becomes greater and the amount of the wound portion 94 becomes less. One important aspect of the present invention, explained in detail below, is that springs 84, 86 are cut to a predetermined length substantially shorter than the length of the magazine.

Figure 10:
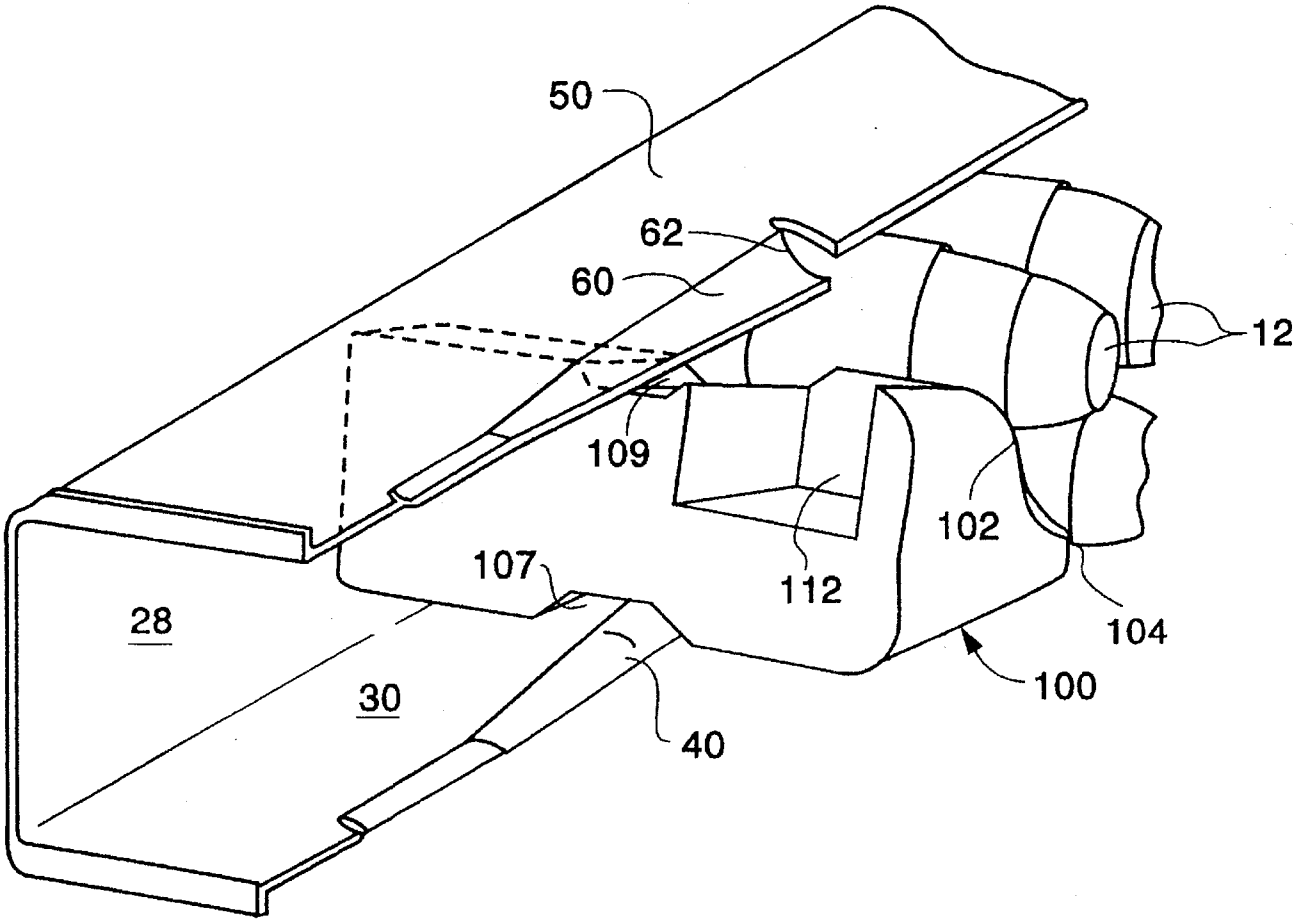
FIG. 10 is a cut-away, perspective view of a cartridge magazine in accordance with the present invention.
Figure 11:
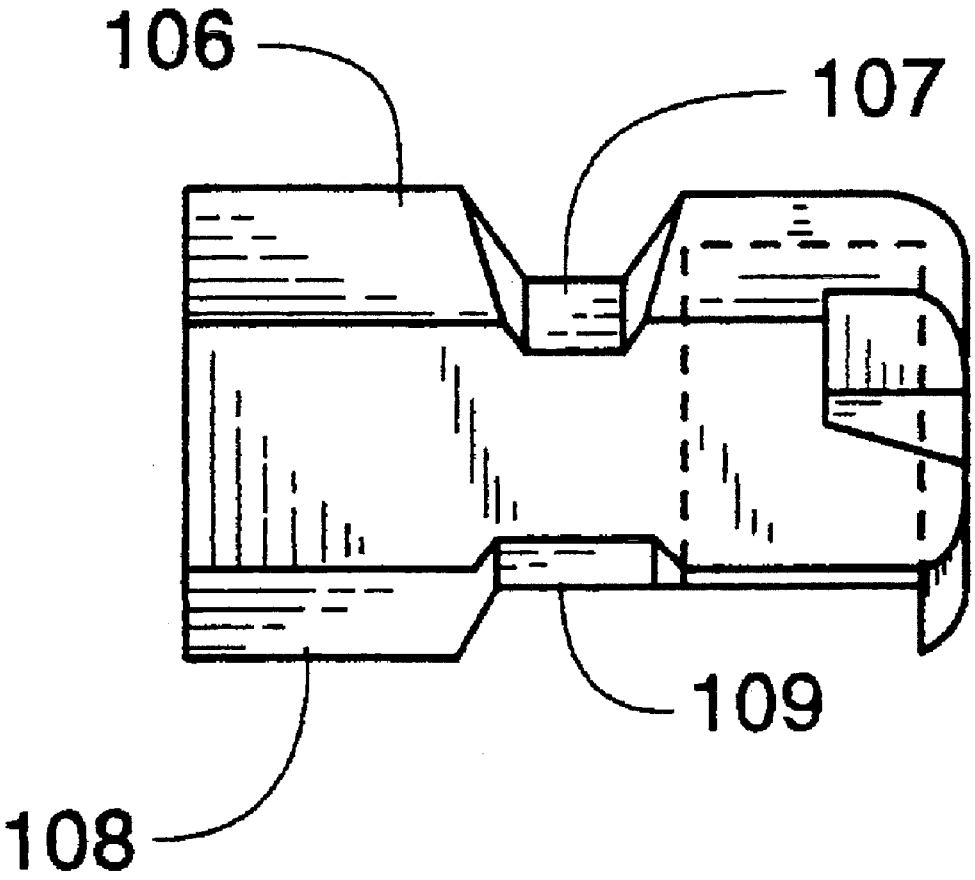
FIG. 11 is a top view of the follower body illustrated in FIG. 10.

A cartridge magazine in accordance with the present invention employs a conventional follower body 100. Referring to FIGS. 10–11, follower body 100 includes a first cartridge contact surface 102 for contacting a first cartridge and a second cartridge contact surface 104 for contacting a second cartridge. Follower body 100 also includes a first side wall 106 extending generally downwardly and outwardly from the first cartridge contact surface, and a second side wall 108 extending generally downwardly and outwardly from the second cartridge contact surface 104 and a bottom surface 110. Each side wall 106, 108 has a substantially vertically extending channel 107, 109 disposed approximately in the middle of the wall. When follower body 100 is disposed within magazine 10, channels 107, 109 are of a size to receive the longitudinally extending ribs 32, 52 in magazine 10 and allow the follower body 100 to pass along the ribs 32, 52, and to pass lips 42, 62 without the follower body 100 being prevented from movement by the ribs 32, 52 or lips 42, 62. A chamber 112 in follower body 100 receives the wound portion 94 of spring unit 82 to permit spring unit 82 to exert a force on follower body 100 to urge follower body 100 toward the open end 22 of magazine 10. While elements of follower body 100 have been described herein, it will be appreciated that the particular configuration of follower body 100 is not critical to the present invention. Accordingly, follower body 100 may assume different configurations. In that regard, it should be understood that, instead of the lips 42, 62 engaging cartridges, the follower body 100 could be configured so that engagement between the follower body 100 and the lips 42, 62 is used to prevent further movement of cartridges and by these prevent insertion of additional cartridges. In such a case, the follower body 100 would not include channels that permit the passage of the follower body 100 past or along the lips 42, 62.

Figure 5:
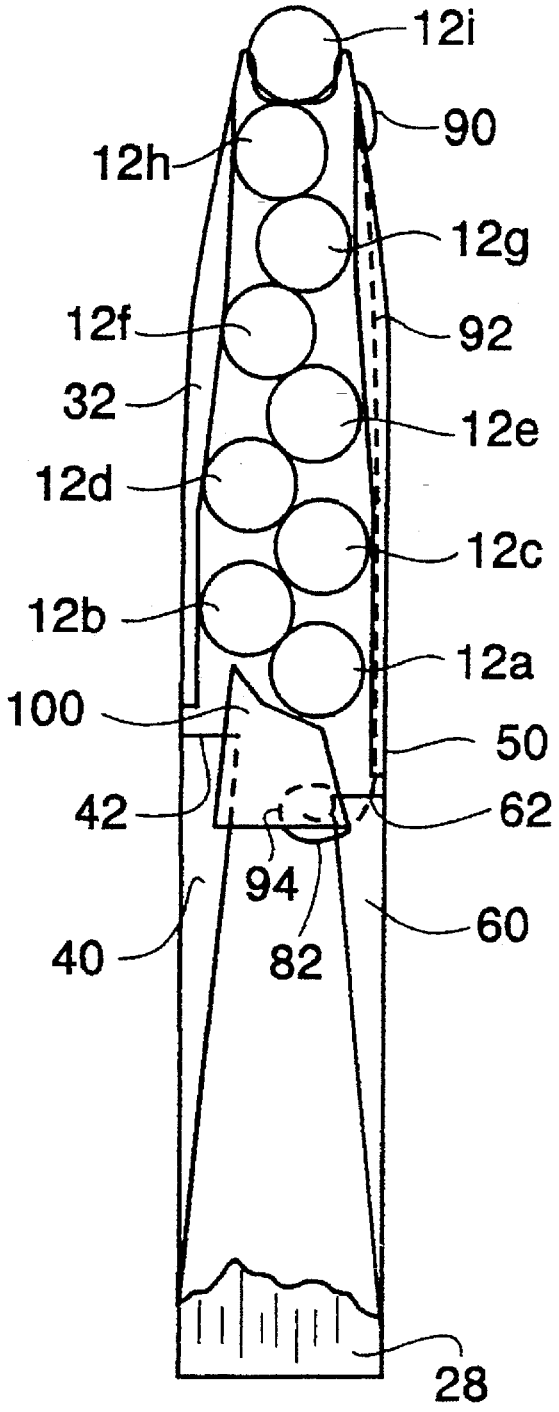
FIG. 5 is a rear view, similar to FIG. 2, of a cartridge magazine in accordance with the present invention illustrating the position of the follower body and the spring when the magazine contains nine cartridges.

FIGS. 5–9 illustrate aspects of the present invention in greater detail. In FIG. 5, a cartridge magazine in accordance with one embodiment of the present invention is filled with nine cartridges 12*a*–12*i*, one fewer than the magazine's predetermined maximum capacity. The unwound portion 92 of spring unit 82 extends generally downwardly from rivet 90 along the side wall 50 of magazine body 20 to follower body 100. The unwound portion 92 of spring 82 unit is illustrated in dashed lines because it is disposed behind upper rib 52 in the view taken in FIGS. 5–9. Additionally, the wound portion 94 of spring unit 82 is shown in dashed lines because it is hidden by follower body 100 in the view taken in FIGS. 5–9. As illustrated, when fewer than ten cartridges are contained within the chamber 70 of magazine 10, the lowermost cartridges 12*a* and 12*b* are above lips 62 and 42, respectively, and the wound portion 94 of spring 82 remains in contact with follower body 100.

Figure 6:
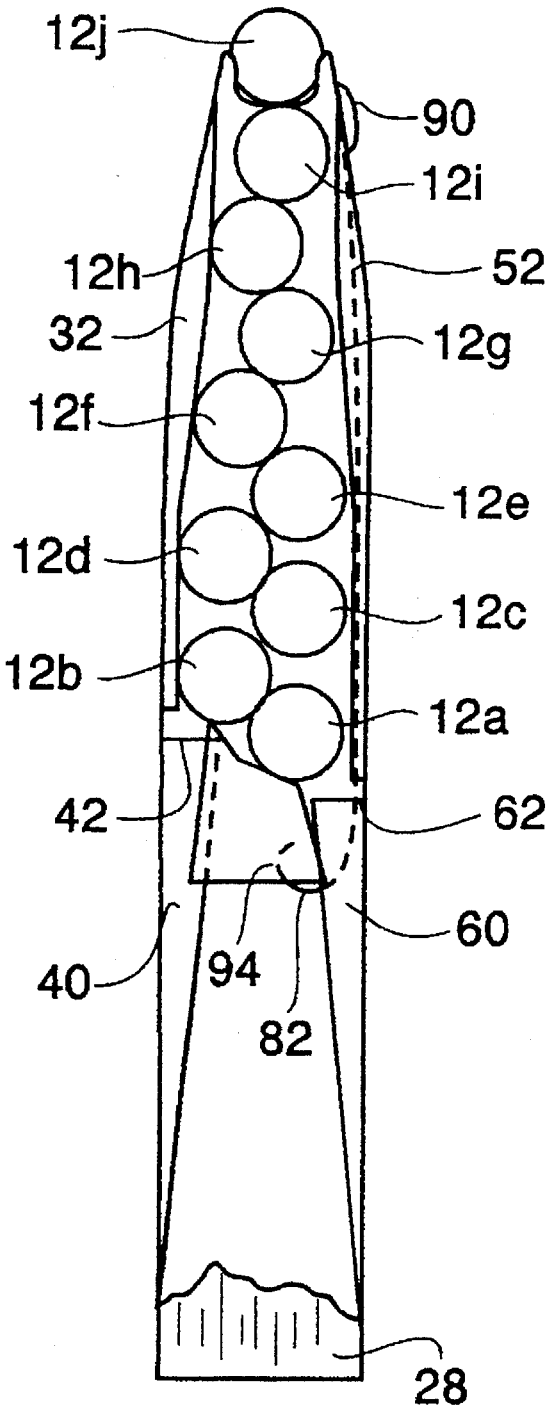
FIG. 6 is a rear view, similar to FIG. 5, of a cartridge magazine in accordance with the present invention illustrating the position of the follower body and the spring when the magazine contains ten cartridges.

FIG. 6 illustrates the magazine 10 loaded to its maximum capacity of ten cartridges 12*a*–12*j*. With ten cartridges in the magazine, a small distance (e.g., less than the diameter of a cartridge) exists between the surfaces of lowermost cartridges 12*a*, 12*b* and lips 42, 62 respectively. It has been determined that it is desirable to provide a small distance between the surfaces of lowermost cartridges 12*a*, 12*b* and lips 42, 62 to respectively facilitate loading the magazine to its maximum capacity. It should be noted that the wound portion 94 of spring unit 82 remains in contact with follower body 100 to exert a force urging follower body 100, and hence cartridges 12*a*–12*i*, toward the open end of the magazine 10.

Figure 7:
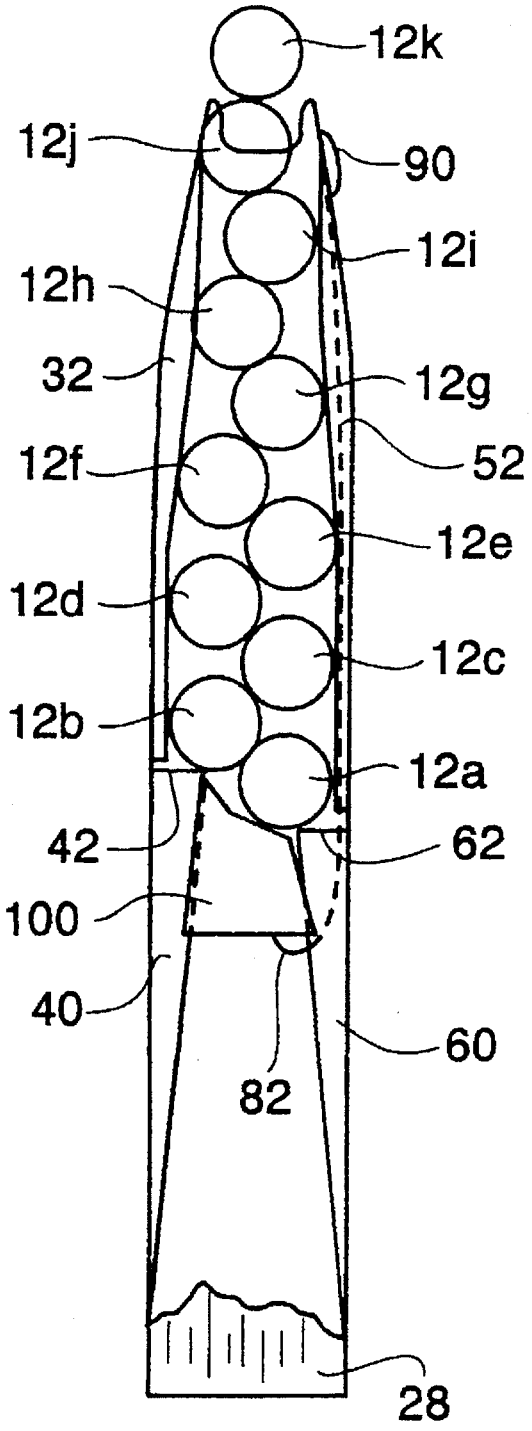
FIG. 7 is a rear view, similar to FIG. 6, of a cartridge magazine in accordance with the present invention when a user attempts to insert the eleventh cartridge into the magazine.

FIG. 7 illustrates the magazine when an attempt is made to load the eleventh cartridge 12*k* (e.g., one beyond the maximum predetermined capacity) into the magazine. As illustrated in FIG. 7, when the user attempts to load the eleventh cartridge 12*k* into the magazine, portions of the two lowermost cartridges 12*a*, 12*b* contact lips 62, 42, respectively, which blocks the downward movement of cartridges 12*a*–12*j* within magazine chamber 70, leaving insufficient space for the eleventh cartridge 12*k* in the magazine chamber 70. Accordingly, the user is not able to insert the eleventh cartridge 12*k* into the magazine 10. In the preferred embodiment, lip 42 is disposed at about the nine and one-half round position and lip 62 is disposed at approximately the ten and one-half round position within the magazine chamber 70.

Figure 8:
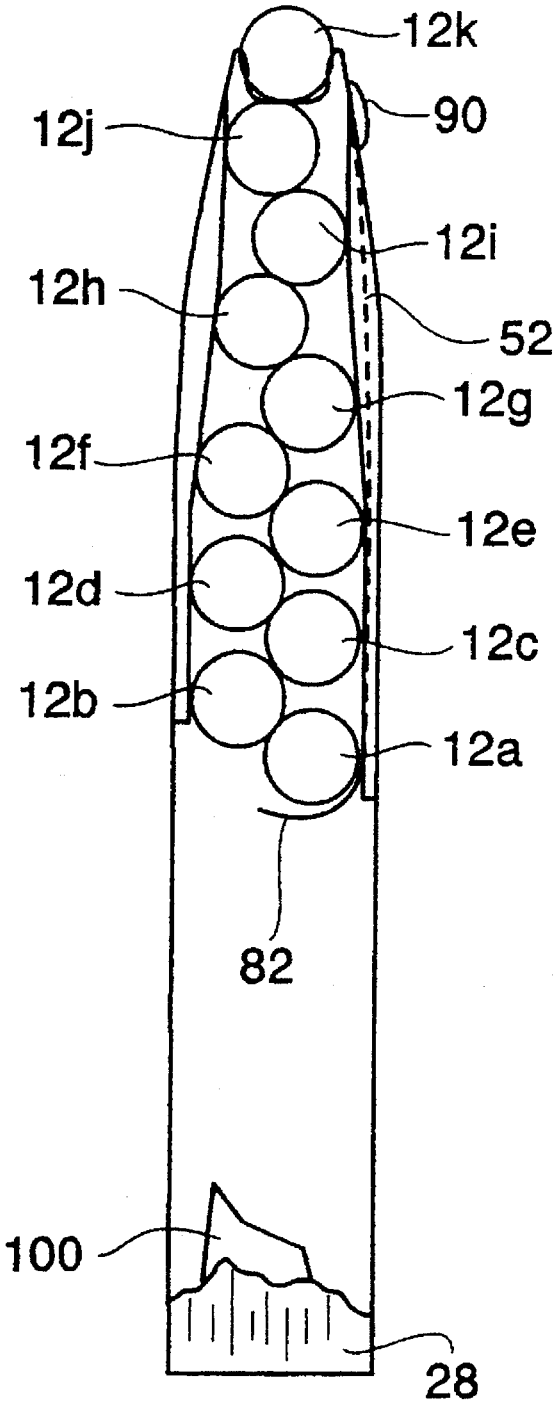
FIG. 8 is a rear view, similar to FIG. 7, of a cartridge magazine in accordance with the present invention which has been altered to allow the magazine to hold more than ten cartridges.
Figure 9:
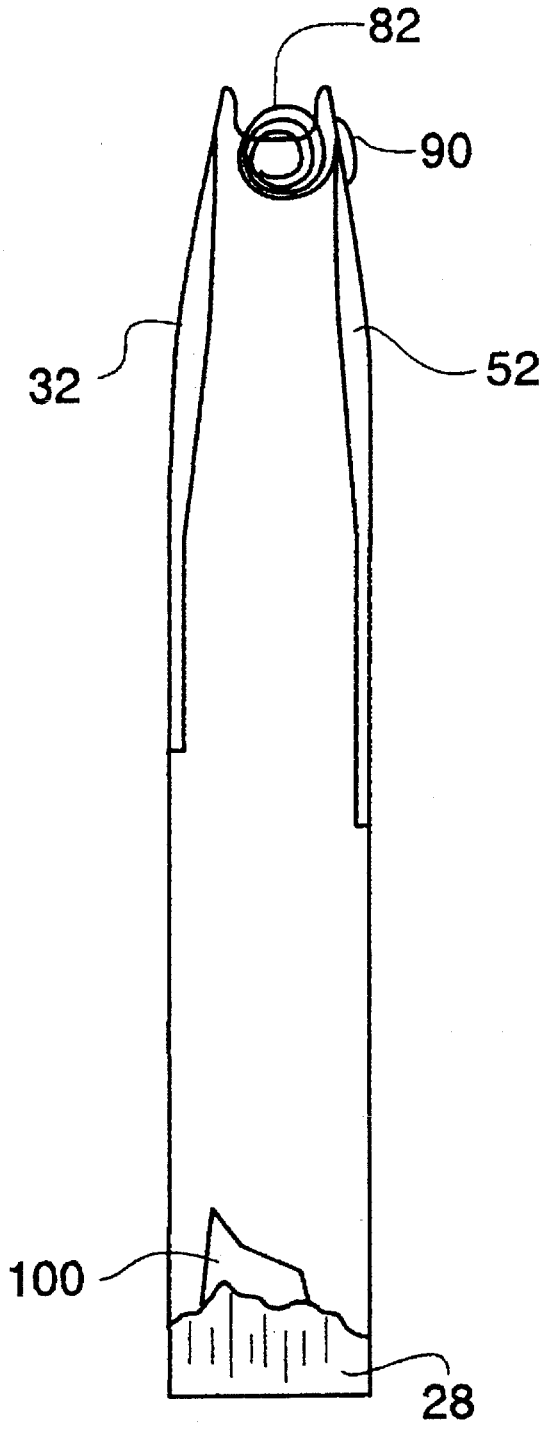
FIG. 9 is a rear view, similar to FIG. 8, of the altered cartridge magazine demonstrating the magazine after the cartridges have been removed.

FIGS. 8–9 illustrate a second aspect of the present invention—namely the modification of the follower assembly 80 to disable the magazine 10 if the magazine is altered by the user in an attempt to increase the capacity of the magazine. More particularly, FIG. 8 illustrates a cartridge magazine 10 in accordance with the present invention in which lower ribs 40 and 60 have been removed, such as by grinding or other similar operations, in an attempt to increase the capacity of magazine 10. When ribs 40 and 60 are removed, the lowermost cartridge 12*a* is able to move beyond the ten and one-half round position at which it would otherwise be stopped by lip 62. Accordingly, the user is able to insert the eleventh cartridge 12*k* into the magazine. However, when the eleventh cartridge 12*k* is inserted, portions of follower body 100 is move past the end of spring unit 82, allowing spring unit 82 to disconnect from follower body 100. When this event occurs, follower body 100 may fall, under force of gravity to the bottom end 24 of magazine 10, as illustrated in FIG. 8. Alternatively, follower body 100 may be forced against side wall 30 by spring unit 82. In either case, follower body 100 cannot exert sufficient force against cartridges 12*a*, 12*b* to move the stack of cartridges 12–12*k* toward open end 22 of magazine 10, and magazine 10 is effectively disabled.

FIG. 9 illustrates the magazine of FIG. 8 after the cartridges 12 have been removed. Spring unit 82 is coiled adjacent to rivet 90 and follower body 100 is resting at the bottom end 24 of magazine 10. Magazine 10 may be reassembled for use by flattening spring unit 82 against side wall 50, positioning follower body 100 adjacent spring unit 82, and releasing spring unit 82. When spring unit 82 recoils, it will re-connect with follower body 100 and force follower body 100 to the open end 22 of magazine 10.

The body 20 of cartridge magazine 10 is preferably made from steel or other suitable material. The magazine body 20 may be manufactured by conventional punching, pressing and welding operations. Spring unit 82 is also preferably manufactured from steel or other suitably resilient material. Follower body 82 is preferably formed from a suitable plastic material. Additionally, magazine 10 preferably includes a conventional base plate (not shown) which is preferably formed from a suitable plastic material.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A magazine for holding cartridges, comprising:

first and second end walls and first and second side walls defining a chamber having a bottom end and an open end through which the cartridges move;

a follower assembly including a follower body mounted in said chamber for movement between a first position adjacent said open end and a second position located a predetermined distance from said open end, a distance being defined between said bottom end and said open end and said predetermined distance being substantially less than the distance from said bottom end to said open end; and means for restricting movement of the cartridges in said chamber at said second position, said means for restricting comprising at least a first blocking member provided on one of said first and second end walls and said first and second side walls for preventing movement of the cartridges in a first direction away from said open end and said blocking member engaging a portion of the lowermost cartridge in the magazine to limit movement of the cartridges in said first direction away from said open end.

2. A cartridge magazine, as claimed in claim 1, wherein:

said predetermined distance from said open end is a function of the space required to hold a predetermined number of cartridges between said follower body and said open end of the magazine.

3. A cartridge magazine, as claimed in claim 2, wherein:

said predetermined number of cartridges is ten.

4. A cartridge magazine, as claimed in claim 1, wherein:

said predetermined distance from said open end is less than seventy-five percent of the distance from said open end to said bottom end.

5. A cartridge magazine, as claimed in claim 1, wherein:

said predetermined distance depends upon the configuration of cartridges within said magazine.

6. A cartridge magazine, as claimed in claim 1, wherein:

said means for restricting further comprises a second blocking member provided on another one of said first and second end walls and said first and second side walls, different from said one wall to limit movement of the cartridges in said first direction away from said open end.

7. A cartridge magazine, as claimed in claim 1, wherein:

a spirally wound conforce spring means having a first end is connected to said magazine adjacent said open end, said spring means includes an unwound portion extending from said first end and a wound portion interconnected with said follower body for applying a force to said follower body.

8. A cartridge magazine, as claimed in claim 7, wherein:

when said follower body is moved beyond said second position, said spring means exerts insufficient force against said follower body to move said follower body toward said open end.

9. A cartridge magazine for holding cartridges, comprising:

first and second end walls and first and second side walls defining a chamber having a bottom end and an open end through which the cartridges move;

a follower assembly including a follower body mounted in said chamber for movement between a first position adjacent said open end and a second position located a predetermined distance from said open end, a distance being defined between said bottom end and said open end, said predetermined distance being substantially less than the distance from said bottom end to said open end;

at least a first blocking member provided on one of said first and second end walls and said first and second side walls for preventing movement of the cartridges in a first direction away from said open end; and force storing means for applying a force to said follower body to move said follower body from said second position to said first position wherein, when said follower body is moved beyond said second position, said force storing means disconnects from said follower body.

10. A magazine for holding cartridges, comprising:

first and second end walls and first and second side walls defining a chamber having a bottom end and an open end through which the cartridges move;

a follower assembly including a follower body mounted in said chamber for movement between a first position adjacent said open end and a second position located a predetermined distance from said open end, said predetermined distance from said open end is a function of the space required to hold a predetermined number of cartridges between said follower body and said open end of the magazine;

a first blocking member provided on one of said first and second end walls and said first and second side walls for preventing movement of the cartridges in a first direction away from said open end; and a spirally wound conforce spring means having a first end connected to the magazine adjacent said open end, an unwound portion extending from said first end and a wound portion interconnected with said follower body for applying a force to said follower body;

wherein said conforce spring means has insufficient force to move a plurality of cartridges, greater than the predetermined number of cartridges, in a direction towards said open end when said first blocking member is removed from the magazine and where said follower body has moved past said second position.

11. A magazine for holding cartridges, comprising:

first and second end walls and first and second side walls defining a chamber having a bottom end and an open end through which the cartridges move;

a follower assembly including a follower body mounted in said chamber for movement between a first position adjacent said open end and a second position located a predetermined distance from said open end;

at least a first blocking member provided on one of said first and second end walls and said first and second side walls for preventing movement of the cartridges in a first direction away from said open end, said first blocking member having an upper end for engaging at least one cartridge to limit its movement, with said upper end being relatively closer to said open end than any other portion of said first blocking member that is able to engage the one cartridge and limit its movement; and force storing means for applying a force to said follower body to move said follower body from said second position to said first position;

wherein at least portions of said follower body moves past said upper end of said first blocking member and in which said force storing means has sufficient force to move the cartridges in a first direction towards said open end of the magazine and said upper end of said first blocking member engages the one cartridge to limit movement thereof in a direction away from said open end after said follower body portions have moved past said upper end.

* * * * *